United States Patent [19]

Everett, Jr.

[11] 4,060,703

[45] Nov. 29, 1977

[54] KEYBOARD SWITCH ASSEMBLY WITH TACTILE FEEDBACK HAVING ILLUMINATED LAMINATED LAYERS INCLUDING OPAQUE OR TRANSPARENT CONDUCTIVE LAYER

[76] Inventor: Seth Leroy Everett, Jr., 196 Priscilla Drive, Lincroft, N.J. 07738

[21] Appl. No.: 740,567

[22] Filed: Nov. 10, 1976

[51] Int. Cl.[2] ..... H01H 13/70; H01H 9/00

[52] U.S. Cl. ..... 200/5 A; 200/159 B; 200/275; 200/292; 200/310; 200/313; 200/317

[58] Field of Search ..... 200/5 R, 5 A, 139 B, 200/275, 308, 310, 314, 317, 340, 313

[56] References Cited

U.S. PATENT DOCUMENTS

| | | | |
|---|---|---|---|
| 3,591,749 | 7/1971 | Comstock | 200/159 B X |
| 3,777,222 | 12/1973 | Harris | 200/317 X |
| 3,784,812 | 1/1974 | Swanberg | 200/317 X |
| 3,811,025 | 5/1974 | Bach | 200/5 A X |
| 3,860,771 | 1/1975 | Lynn et al. | 200/159 B X |
| 3,978,297 | 8/1976 | Lynn et al. | 200/5 A |
| 3,988,551 | 10/1976 | Larson | 200/5 A |
| 3,995,126 | 11/1976 | Larson | 200/5 A |
| 4,022,993 | 5/1977 | Shattuck | 200/5 A |
| 4,024,368 | 5/1977 | Shattuck | 200/5 A |

FOREIGN PATENT DOCUMENTS

| | | | |
|---|---|---|---|
| 2,512,228 | 10/1975 | Germany | 200/314 |

*Primary Examiner*—James R. Scott
*Attorney, Agent, or Firm*—Nathan Edelberg; Sheldon Kanars; Edward Goldberg

[57] ABSTRACT

A sandwich type computer keyboard with keys characterized by a tactility to provide a positive degree of tactile feedback to an operator and having an electroluminescent panel for illuminating the keyboard panel.

14 Claims, 3 Drawing Figures

KEYBOARD SWITCH ASSEMBLY WITH TACTILE FEEDBACK HAVING ILLUMINATED LAMINATED LAYERS INCLUDING OPAQUE OR TRANSPARENT CONDUCTIVE LAYER

The invention described herein may be manufactured, used and licensed by or for the Government for governmental purposes without the payment to me of any royalties thereon.

BACKGROUND OF THE INVENTION

This invention relates to a sandwich type computer keyboard and more particularly to keyboards for use with hand-held message terminal devices.

In miniature message terminal devices, keyboards utilized for the entry of data should possess the following characteristics: (1) be flat and lightweight; (2) be capable of being efficiently illuminated; (3) provide a tactile feedback to the operator; (4) provide the capability of changing legends without disturbing the remainder of the keyboard; and (5) be low in cost to produce. While presently known keyboards may combine several of these characteristics, none are available which combine all five of these characteristics. For example, some keyboards are available which meet all the criteria noted above except for characteristic (3), the provision of tactile feedback. Others may provide all the criteria noted above except for characteristic (2), the provision of efficient illumination.

SUMMARY OF THE INVENTION

It is an object of the present invention to provide a sandwich type computer keyboard which combines all the desirable characteristics noted above.

In accordance with one embodiment of the present invention there is provided a sandwich type computer keyboard including a bezel in which the components of the keyboard are sandwiched and which is provided with parallel arranged apertures. Also included is a first mylar sheet having a raised tactile bubbled surface with the bubbles being arranged and spaced to correspond to the bezel apertures and to pass therethrough beyond the bezel surface. Included further are an electroluminescent panel and an electrical conductive sheet or elastomer. A first apertured insulation sheet is intermediate the electroluminescent panel and the first bubbled mylar sheet. Included further is a printed circuit board having respective conductors thereon arranged to correspond with the tactile bubbled mylar surface. A second apertured insulation sheet is intermediate the conductive sheet and the printed circuit board. With such an arrangement, the tactile bubbled mylar surface is illuminated and provides both the keying function to energize the printed circuit conductors and a positive degree of tactile feedback.

In accordance with another embodiment of the present invention there is provided a sandwich type keyboard including a bezel in which the components of the keyboard are sandwiched and which is provided with parallel arranged apertures. Also included is a first mylar sheet having a raised tactile bubbled surface with the bubbles being arranged and spaced to correspond to the bezel apertures and to pass therethrough beyond the bezel surface. Included further is a stiffener sheet having a tactile bubbled surface nestled within the concave surface of each of the bubbles on the first mylar sheet and a transparent electrical conductive coating on the concave surfaces of the stiffener sheet bubbles. Also included is a transparent or translucent printed circuit sheet having respective transparent conductors thereon arranged to correspond with the tactile bubbled surface on the first mylar sheet and an apertured insulator spacer is intermediate the printed circuit sheet and the stiffener sheet. Included further is an electroluminescent panel proximal the printed circuit sheet.

DESCRIPTION OF THE PREFERRED EMBODIMENT

Figure 1:
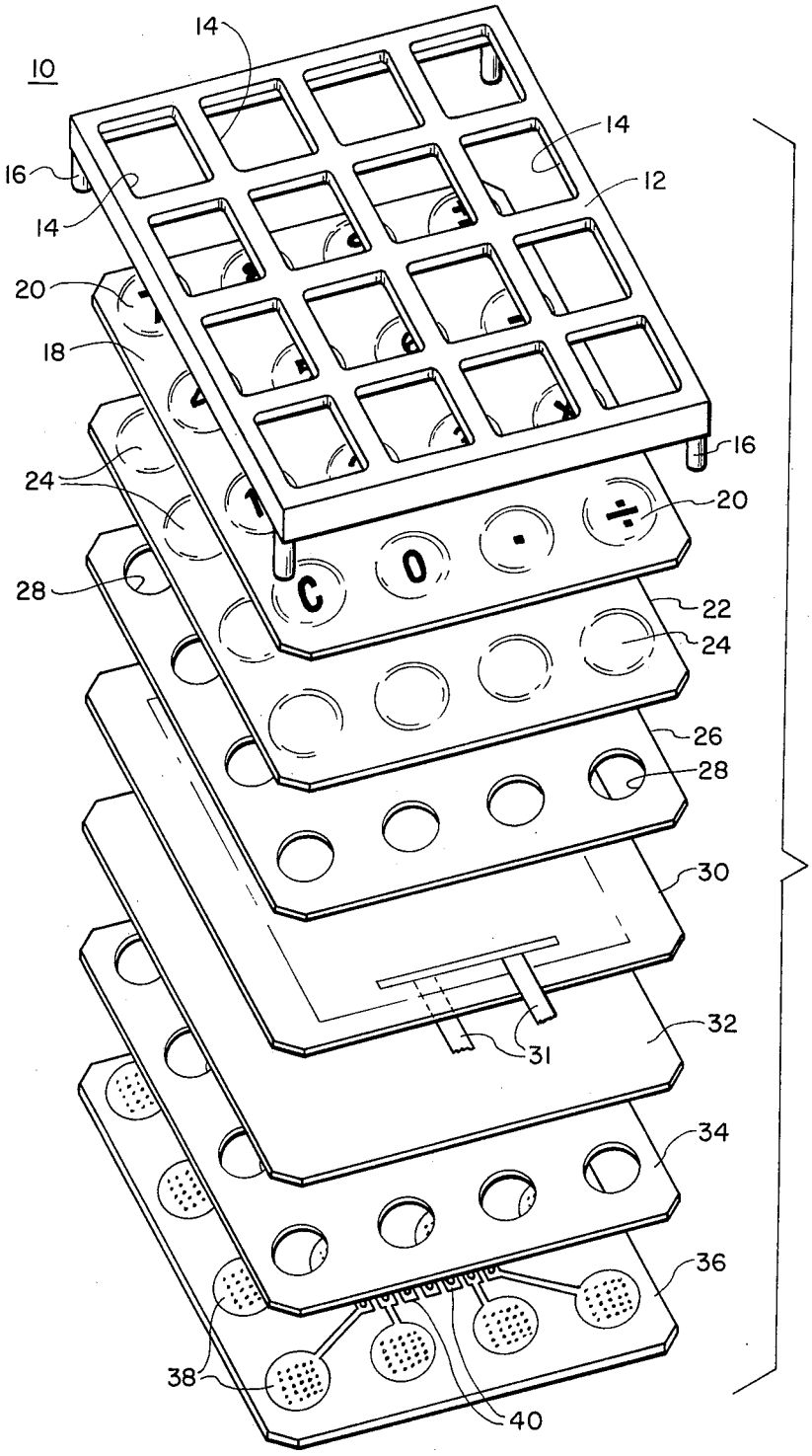
FIG. 1 illustrates an exploded view of one embodiment of the present invention.
Figure 2:
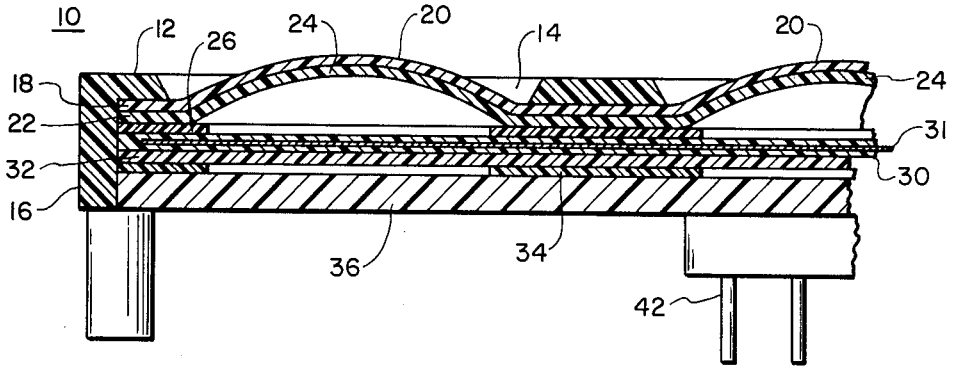
FIG. 2 is a cross-section illustrating the sandwich arrangement of the embodiment shown in FIG. 1.

Referring now to FIGS. 1 and 2 of the drawing, the keyboard is shown at 10 and comprises seven elements or components mounted within a rectangular frame or bezel 12 to form a sandwich type computer keyboard. Bezel 12 provides conventional parallel arranged apertures 14 and includes end support posts 16 to provide proper alignment for maintaining all seven elements in correct juxtaposed position. In the description below, the elements are listed in the order as they descend from bezel 12. Proximal bezel 12 is a mylar translucent sheet 18 having parallel arranged raised, preferably circular portions or bubbles 20 which are adapted to be respectively positioned within each of the bezel apertures 14. The bubbles 20 are dimensioned to pass through the bezel apertures and extend beyond the bezel surface. The bubbles 20 have a tactility such that when pressure is applied thereto, the bubbles 20 will move inwardly but will instantly spring back to their normal bubble shape when the pressure is removed thereby providing tactile feedback to the operator. As shown, the bubbles 20 are labeled with alphanumeric legends well known in the art. Adjacent translucent bubbled mylar sheet 18 is a second translucent mylar sheet 22 with parallel raised, preferably circular portions, or bubbles 24 arranged identical to the bubbles 20 of mylar sheet 18. However, the bubbles 24 are made slightly smaller so that when sheet 22 abuts mylar sheet 18, the bubbles 24 will nestle within the indented or concave portions of bubbles 20 of mylar sheet 18. By such an arrangement, mylar sheet 22 adds stiffness to mylar sheet 18 thereby enhancing the tactility characteristic thereof. Proximal bubbled mylar stiffener sheet 22 is a first insulator sheet, or spacer, 26 provided with apertures 28 which are aligned with the bubbles 24 of mylar stiffener sheet 22 and are identical in size thereto. Positioned adjacent first insulator sheet 26 is a flexible electroluminescent (EL) panel 30 which provides illumination for keyboard 10. Electroluminescent panel 30 is provided with a pair of conductors 31 to which is applied a conventional a-c voltage source (not shown). Adjacent to flexible (EL) panel 30 is a conductive sheet 32 which may comprise either an elastomer or a mylar sheet provided with a conductive coating. The conductive coating may either be opaque or transparent as desired. Positioned proximal conductive sheet 32 is a second apertured insulation sheet, or spacer, 34 which is identical to first insulation spacer 26. The last element of the keyboard is printed circuit backboard 36, one surface of which includes parallel arranged circular conductors 38 with a respective circular conductor corresponding to and aligned with a respective bubble 20 of mylar tactile sheet 18. Each circular conductor 38 is connected to a flat terminal 40 provided therefor on circuit backboard 36, and flat terminal 40 in turn is connected to a pin as at 42 to provide electrical circuit connections. When all the keyboard components are arranged within bezel 12, a sandwich type keyboard is provided as shown in FIG. 2. If desired, elements 22, 26, 30, 32, 34 and 36 may be sealed as one unit and bezel 12 with legended bubbles 20 may comprise a separate unit. By such an arrangement, the alphanumerical legends may readily be changed without affecting the rest of the keyboard elements.

The operation of keyboard 10 is similar to any conventional keyboard operation. However with the arrangement described above, direct tactile feedback is provided together with excellent illumination characteristics.

Figure 3:
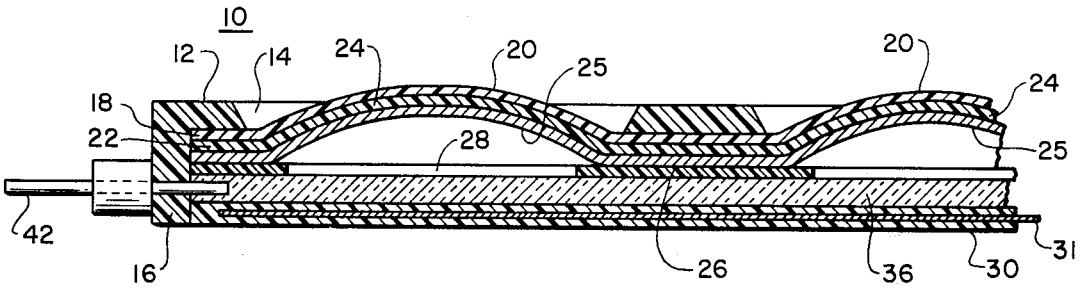
FIG. 3 is cross-section illustrating the sandwich arrangement of another embodiment of the present invention.

FIG. 3 illustrates another embodiment of the present invention. Referring now to FIG. 3, wherein like elements refer to like components, the sandwich type keyboard 10 comprises five elements or components mounted within rectangular frame or bezel 12. As in FIG. 1, bezel 12 provides conventional parallel arranged apertures 14 and include end support posts 16 to provide proper alignment for maintaining all five elements in correct juxtaposed position. Proximal bezel 12 is mylar translucent sheet 18 having parallel arranged raised, preferably circular, portions or bubbles 20 which are adapted to be respectively positioned within each of the bezel apertures 14. The bubbles 20 have a tactility such that when pressure is applied thereto, the bubbles 20 will move inwardly but will instantly spring back to their normal bubble shape when the pressure is removed thereby providing tactile feedback to the operator. Proximal bubbled mylar sheet 18 is a second translucent mylar sheet 22 with parallel raised, preferably circular portions, or bubbles 24 arranged identical to the bubbles 20 of mylar sheet 18. However, the bubbles 24 are made slightly smaller so that when sheet 22 abuts mylar sheet 18, the bubbles 24 will nestle within the indented or concave portions of bubbles 20 of mylar sheet 18. The respective indented or concave surfaces of bubbles 24 are coated with a transparent electrical conductive coating 25. Mylar sheet 22 adds stiffness to mylar sheet 18 thereby enhancing the tactility characteristic thereof. Proximal bubbled mylar stiffener 22 is an insulator sheet, or spacer, 26 provided with apertures 28 which are aligned with the bubbles 24 of mylar stiffener sheet 22 and are identical in size thereto. Adjacent to spacer insulator sheet 26 is printed circuit sheet 36 made of translucent or transparent mylar and which includes parallel arranged circular transparent conductors arranged such that a respective circular transparent conductor is aligned with a respective bubble 20 of mylar tactile sheet 18. As shown in FIG. 1, each circular conductor is connected to a flat terminal 40, and flat terminal 40 in turn is connected to a pin as at 42 to provide electrical circuit connections. The last element of the keyboard 10 is a flexible or rigid electroluminescent (EL) panel 30 which provides illumination for keyboard 10. As shown in FIG. 1, electroluminescent panel 30 is provided with a pair of conductors 31 to which is applied a conventional a-c source.

What is claimed is:

1. A sandwich type computer keyboard comprising:
a bezel having parallel arranged apertures;
a first mylar sheet having a raised tactile bubbled surface, the bubbles being arranged and spaced to correspond to said apertures and dimensioned to pass through said apertures and extend beyond the upper bezel surface;
a flexible electroluminescent panel;
a flexible electrical conductive sheet adjacent said electroluminescent panel;
a first apertured insulator sheet intermediate said electroluminescent panel and said first mylar sheet;
a printed circuit board having respective conductors thereon arranged to be aligned and correspond with the tactile bubbled surface on said first mylar sheet; and
a second apertured insulator sheet intermediate said conductive sheet and said printed circuit board;
the apertures in said first and second insulator sheets being aligned with and corresponding to the tactile bubbled surface on said first mylar sheet.

2. The keyboard in accordance with claim 1 and further including a stiffener sheet of light translucent insulating material having a tactile bubbled surface nestled within the concave surfaces of the bubbles on said first mylar sheet.

3. The keyboard in accordance with claim 2 wherein said stiffener sheet is made of mylar.

4. The keyboard in accordance with claim 3 wherein said first mylar sheet and said stiffener sheet are translucent.

5. The keyboard in accordance with claim 1 wherein said conductive sheet comprises a mylar sheet provided with a conductive coating.

6. The keyboard in accordance with claim 1 wherein said conductive sheet comprises an elastomer.

7. The keyboard in accordance with claim 5 wherein said conductive coating is opaque.

8. The keyboard in accordance with claim 5 wherein said conductive coating is transparent.

9. The keyboard in accordance with claim 2 wherein said conductive sheet comprises an elastomer.

10. A sandwich type computer keyboard comprising:
a bezel having parallel arranged apertures;
a first mylar sheet having a raised tactile bubbled surface, the bubbles being arranged and spaced to correspond to said apertures and dimensioned to pass through said apertures and extend beyond the upper bezel surface;
a stiffener sheet having a tactile bubbled surface nestled within the concave surface of each of the bubbles on said first mylar sheet;
a transparent electrical conductive coating on the concave surfaces of the bubbles on said stiffener sheet;
a light transmissive printed circuit sheet having respective transparent conductors thereon arranged to correspond with the tactile bubbled surface on said first mylar sheet;
an apertured insulator spacer sheet intermediate said printed circuit sheet and said stiffener sheet;
the apertures in said insulator spacer sheet corresponding to the tactile bubbled surface of said first mylar sheet;
and an electroluminescent panel proximal said printed circuit sheet.

11. The keyboard in accordance with claim 10 wherein said first mylar sheet and said stiffener sheet are translucent.

12. The keyboard in accordance with claim 10 wherein said printed circuit sheet is transparent.

13. The keyboard in accordance with claim 10 wherein said printed circuit sheet is translucent.

14. The keyboard in accordance with claim 10 wherein said electroluminescent panel is rigid.

* * * * *